US011840902B2

(12) United States Patent
Fairweather et al.

(10) Patent No.: US 11,840,902 B2
(45) Date of Patent: Dec. 12, 2023

(54) WELL ABANDONMENT

(71) Applicant: Ardyne Holdings Limited, Aberdeen (GB)

(72) Inventors: Alan Fairweather, Aberdeen (GB); David Stewart, Aberdeen (GB)

(73) Assignee: ARDYNE HOLDINGS LIMITED, Aberdeen (GB)

( * ) Notice: Subject to any disclaimer, the term of this patent is extended or adjusted under 35 U.S.C. 154(b) by 8 days.

(21) Appl. No.: 17/719,448

(22) Filed: Apr. 13, 2022

(65) Prior Publication Data

US 2022/0333454 A1 Oct. 20, 2022

(30) Foreign Application Priority Data

Apr. 19, 2021 (GB) ..... 2105602

(51) Int. Cl.
*E21B 31/16* (2006.01)
*E21B 31/20* (2006.01)
*E21B 29/00* (2006.01)

(52) U.S. Cl.
CPC ..... *E21B 31/16* (2013.01); *E21B 31/20* (2013.01); *E21B 29/005* (2013.01)

(58) Field of Classification Search
None
See application file for complete search history.

(56) References Cited

U.S. PATENT DOCUMENTS 3,268,003 A * 8/1966 Essary ..... E21B 31/03 166/301
3,727,685 A * 4/1973 Chestnut ..... E21B 29/02 166/301

(Continued)

FOREIGN PATENT DOCUMENTS

EP 1890000 A1 2/2008
GB 2473527 B 11/2013

(Continued)

OTHER PUBLICATIONS

Kessler, C. et al; A New Wireline Logging Method For Determination of Free Point to Assist Pipe Recovery Operations; American Association of Drilling Engineers 2009 National Technical Conference, AADE 2009NTCE-09-05; 2009; AADE; New Orleans Louisiana.

(Continued)

*Primary Examiner* — David Carroll
(74) *Attorney, Agent, or Firm* — LAW OFFICE OF JESSE D. LAMBERT, LLC

(57) ABSTRACT

A method of recovering casing from a wellbore in which: a logging tool is run to an estimated stuck point of the casing through the central bore of the casing spear and casing cutter; the casing spear is attached to the casing and tension applied so that logging can be performed over a length at an estimated stuck point both with and without tension to provide the verified stuck point; and the casing cutter is positioned relative to this to cut the free casing; and the spear used to remove it. The method can be performed on a single trip. Embodiments include incorporating a packer to circulate fluid during casing cutting; a disconnect, anchor mechanism and motor to allow use of a motor to operate the cutter; and a Down Hole Power Tool with a method of establishing the required force to recover a length of stuck casing.

19 Claims, 3 Drawing Sheets

(56) References Cited

U.S. PATENT DOCUMENTS

Figures 1A, 1B, 1C, 1D, 1E, 1F, 1G:
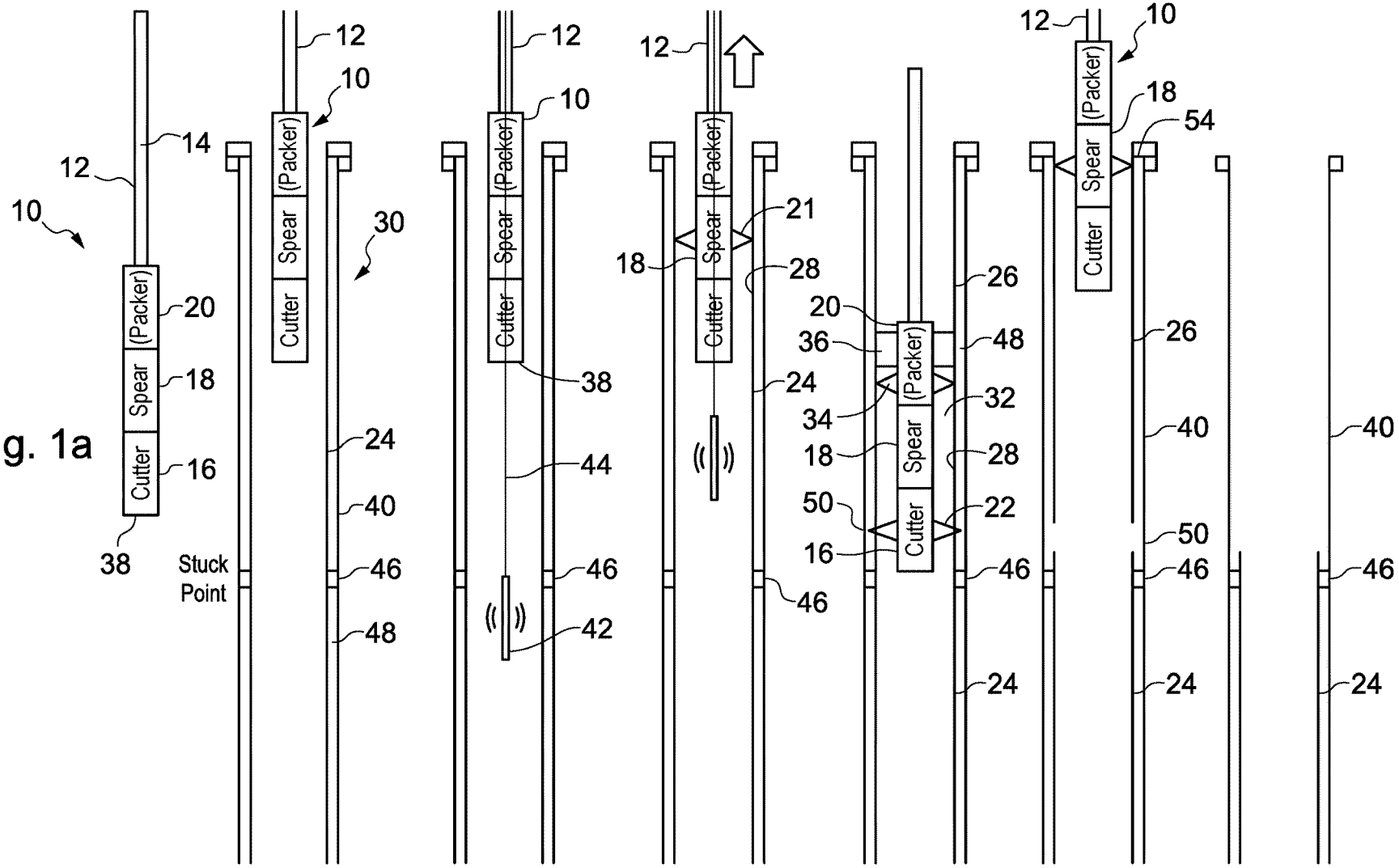

| | | | | |
|---|---|---|---|---|
| 4,444,050 | A * | 4/1984 | Revett | E21B 47/09 73/152.56 |
| 8,079,414 | B2 | 12/2011 | Smaardyk | |
| 2005/0053473 | A1* | 3/2005 | Khomynets | E21B 47/00 417/172 |
| 2008/0042870 | A1* | 2/2008 | Orban | E21B 47/092 340/854.4 |
| 2010/0257927 | A1* | 10/2010 | Smaardyk | E21B 47/09 73/152.56 |
| 2020/0224509 | A1* | 7/2020 | Telfer | E21B 31/20 |
| 2021/0199837 | A1 | 7/2021 | Gulliver et al. | |

FOREIGN PATENT DOCUMENTS

| | | | |
|---|---|---|---|
| GB | 2561814 | B | 5/2019 |
| GB | 2574647 | A | 12/2019 |

OTHER PUBLICATIONS

Intellectual Property Office of the UK Patent Office, Search Report for GB2205647.7; dated Aug. 31, 2022; all pages; Intellectual Property Office of the UK Patent Office, Newport, United Kingdom.

* cited by examiner

WELL ABANDONMENT

The present invention relates to apparatus and methods for well abandonment and in particular, though not exclusively, to an apparatus and method for casing recovery.

There are occasions in oilfield operations, for instance during well abandonment, when it is desired to pull casing from a wellbore. Conventionally, a casing cutter would be run into the wellbore and a cut made at a pre-determined depth. A spear would then be run into the wellbore to latch into the casing section and, by pulling with the rig, the casing section may be removed. These two operations may be performed in the same trip into the wellbore using tools such as provided by the applicant. This procedure is known and is described in GB2561814B to Ardyne Holdings Ltd.

Experience demonstrates that the casing section cannot always be recovered by pulling with the rig alone. After many years in the wellbore, solids from the drilling mud can settle on the outside of the casing thereby increasing the force required to release a pre-cut casing section. On these occasions it has been necessary to use specialist tools that are able to apply higher forces than the rig alone is able to apply. Tools are available that grip an outer casing string and by application of pressure, pull high forces on the stuck casing. This procedure is known and is described in GB2473527B to Ardyne Holdings Ltd. Tools used in this procedure are referred to as 'Down Hole Power Tools'.

When it is necessary to use a Down Hole Power Tool it is quite often the case that the entire piece of stuck casing cannot be removed in one trip. This is because the force required to remove it is so large that damage would be done to the casing itself. In such a case, the casing piece is cut into shorter lengths so that the required force to free the casing is manageable. Deciding where to cut the casing piece is often a matter of guesswork, as until now there was no reliable method of estimating the force required to dislodge a particular length of the stuck casing.

In order to decide which type of downhole tool it is best to deploy, it is helpful to identify the 'stuck point'. The stuck point is the position in the string where the casing is not free to move relative to the outer casing string or open hole. In practice the stuck point may not be at a specific position, the casing may gradually become stuck over a distance as the resistance to dislodging the casing increases. The stuck point may therefore refer to a single location or a distance between positions where the casing is substantially free and substantially stuck.

There are various methods for identifying the stuck point that are well known in the industry. One such method utilises wireline tools that log the pipe using the magnetostrictive effect (for instance see AADE 2009NTCE-09-05 Kessler, Weiser & Hill). This example uses the technique to identify stuck point in drill pipe. The magnetostrictive effect is a material property that relates a change of material shape due to applied magnetic fields. In the example given, a log is taken before and after applying tension to the stuck pipe and by comparing the two logs, the stuck point can be identified. A similar method is described in U.S. Pat. No. 8,079,414.

After the stuck position has been determined, tools are deployed into the well to cut the pipe above the stuck point and the pipe is then recovered.

It is an object of at least one embodiment of the present invention to provide a method of recovering casing from a wellbore in which the stuck point is established, the casing is cut at a location above the stuck point and the casing is recovered in a single trip into the wellbore.

It is a further object of at least one embodiment of the present invention to provide a method of establishing the required force to recover a length of stuck casing.

According to a first aspect of the present invention there is provided a method of recovering casing from a wellbore, comprising the steps:

(a) mounting a bottomhole assembly (BHA) on a pipe string, the BHA comprising a casing cutter and a casing spear;
(b) running the BHA into the casing;
(c) locating the casing spear at an upper point in the casing, the upper point being above an estimated stuck point;
(d) mounting a logging tool on a wireline string and running the wireline string through a central bore of the pipe string to exit the pipe string below the casing spear;
(e) logging a first length of the casing with the logging tool by movement of the wireline string, the first length including the estimated stuck position;
(f) applying tension to the casing by pulling the pipe string upwards, with the casing spear anchored to the casing;
(g) logging a second length of the casing with the logging tool by movement of the wireline string, the second length including the estimated stuck position and overlapping at least a portion of the first length;
(h) identifying a verified stuck point by comparison of logs of step (e) and step (g);
(i) moving the casing cutter to a cutting position relative to the identified stuck point;
(j) cutting the casing to provide a cut section of casing; and
(k) pulling the pipe string with the casing spear anchored to the cut section of casing to recover the cut section of casing from the wellbore.

By running a wireline logging tool through the pipe string on which the BHA is deployed, and out of an end thereof, the steps of identifying the stuck point, cutting the casing and pulling the casing can all be achieved on a single trip into the wellbore. The casing being recovered may be located in an open borehole or may be an inner casing string located within an outer casing string.

Preferably, the logging tool is a wireline deployable magnetostrictive tool. It will be appreciated that the wireline tool has to have clear access through the end of the drill string below the spear so that the magnetostrictive tool can log the casing.

Depending on the particular logging tool deployed, step (g) may be done whilst the casing is held in tension at step (f). Alternatively, step (g) may be done after tension has been released following step (f).

Preferably, the method includes the step of recovering the wireline string from the well bore. Preferably, the step of recovering the wireline string from the well bore is completed before step (j) and more preferably before step (i).

The BHA may further comprise a packer, the packer being located above the cutter in the assembly. The method may include the step of setting the packer and pumping fluid through the pipe string to the cutting position to circulate fluid preferentially up an outside of the cut section of casing. In this way, fluid is blocked from travelling up the annulus between the pipe string and the casing, the fluid thus travelling up the outside of the cut section of casing to help clear this area and so aid recovery.

The method may include the step of operating the cutter to radial extend blades to cut the casing. Preferably the blades are rotated by virtue of rotation of the casing cutter to perform the cut. The method may include the step of rotating the pipe string from surface to rotate the casing cutter. Alternatively, the BHA may include a motor, the motor operating to rotate the casing cutter. In this embodiment, the BHA may further include an anchor mechanism such as the packer. More preferably the BHA includes in order the casing spear, a disconnect, an anchor mechanism, the motor and the casing cutter. The method may then include, between steps (b) and (c), the additional steps of:

(i) locating the anchor mechanism at a lower point in the casing, the lower point being below the estimated stuck point in the casing;

(ii) operating the anchor mechanism to anchor the BHA to the casing at the lower point; and (iii) operating the disconnect to release the casing spear and the pipe string from the BHA;

and between steps (g) and (i), the additional steps of:

(iv) running the casing spear down to the anchor mechanism and reconnecting the BHA to the pipe string; and (v) disengaging the anchor mechanism from the casing;

In this way, a motor may be used to operate the cutter, without obstructing the passage of the wireline logging tool. Preferably, the anchor mechanism is part of the packer. This reduces the number of tools needed in the pipe string.

The BHA may further comprise a Down Hole Power Tool. The method may then include the additional steps of using the Down Hole Power Tool to pull the pipe string at step (k) to assist in recovery of the cut section of casing, as is known in the art. In this embodiment the Down Hole Power Tool could be operated by pumping balls through a drop ball seat, the drop ball seat having a clear access path for the logging tool on the wireline string, to pass therethrough.

It will be appreciated that steps (e) to (g) may be repeated over other pairs of first and second length if a verified stuck point is not identified at step (h). If required a new estimated stuck point can be determined and the casing spear moved reposition it as per step (c).

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings and elements of the embodiments discussed below may be employed separately or in any suitable combination to produce the desired results. Additionally, while relative terms such as 'upper' and 'lower' are used and the drawings indicate vertical wells, the invention finds application in deviated wells.

Embodiments of the present invention will now be described, by way of example only, with reference to the accompanying drawings of which:

FIGS. 1*a* to 1*g* illustrate steps in a method of recovering casing from a wellbore according to a first embodiment of the present invention;

FIGS. 2*a* to 2*g* illustrate steps in a method of recovering casing from a wellbore according to a second embodiment of the present invention; and FIGS. 3*a* to 3*g* illustrate steps in a method of recovering casing from a wellbore according to a third embodiment of the present invention.

Referring initially to FIG. 1*a* there is illustrated a downhole bottom hole assembly (BHA) 10 located on a drill string 12, being a pipe string with a central throughbore 14, for use in a method of recovering casing 24 from a wellbore 30 (see FIG. 1*b*) according to a first embodiment of the present invention. The BHA 10 includes a casing cutter 16, a casing spear 18 and optionally a packer 20. The cutter 16 is positioned below the spear 18 and the packer 20, if present, is positioned above the spear 18.

Casing cutters are known in the industry and may typically comprise a number of blades 22 which remain retracted until such time as cutting is required. When actuated the blades 22 move outwards to contact the inner surface 28 of the casing 24 and by rotation of the cutter 16, the blades will cut the casing 16 to provide a cut section of casing 26 (FIG. 1*e*)

Casing spears are known tools used in casing recovery. Such spears 18 typically include a gripping mechanism 21 which attaches to the inner surface 28 of the casing 24. (FIG. 1*d*) A casing spear 18 is used to attach to a cut section of casing 26 and by pulling the string 12 to which the spear 18 is attached the cut section of casing can be removed from a wellbore.

Packers are used in a wellbore to create a seal between the string 12 and the inner surface 28 of the casing 24 over the annulus 32. Elastomeric materials may be used to create the seal 36. Additionally, a packer 20 will have an anchoring mechanism 34 which may comprise slips with gripping elements to attach to the inner surface 28 of the casing 24 and hold the packer 20 in place to assist in actuating the seal (FIG. 1*e*).

The casing cutter 16, casing spear 18 and optional packer 20 all include a central throughbore being a continuation of the throughbore 14 of the drill string 12.

Initially the casing cutter 16, casing spear 18 and optional packer 20 are arranged in order on the drill string 12 so that the cutter 16 is at the end 38 of the BHA 10, as shown in FIG. 1*a*.

The BHA 10 is then run into the wellbore 30 as shown in FIG. 1*b*. The wellbore 30 as a casing 24 which is shown inside an outer casing 40. Alternatively, the casing 24 may be in an open borehole. The BHA is run into the wellbore 30 until the cutter 16 and more particularly the end 38 of the BHA 10 is above the estimated stuck point (FIG. 1*b*). The estimated stuck point may be determined by known methods such as a stretch test.

A logging tool 42 is mounted on a wireline string 44. In this embodiment, the logging tool 42 is a magnetostrictive tool but may be any logging tool with dimensions small enough to fit through down the throughbore 14 of the drill string 12. The wireline string 44 with magnetostrictive tool is then deployed through the drill pipe 12 down the throughbore 14 from surface until it exits the end 38 into the casing (FIG. 1*c*). A first log of the casing interval is made between a depth above the estimated stuck point to a depth below the estimated stuck point. The stuck point 46 is located in the annulus 48 between the casing 24 and the outer casing 40. Next the spear 18 is set in the casing 24 and the casing 24 is then put into tension by pulling upwards on drill string (FIG. 1*d*). A second log of the casing interval is then made between a depth above the estimated stuck point to a depth below the estimated stuck point.

The two casing logs are compared and the position of the verified stuck point 46 is determined.

The casing spear 18 is released and the drill string 12 is then lowered until the cutter 16 is above the verified stuck point 46. The casing 24 is then cut at a point 50 where it is known that the casing 24 is free. Cutting the casing 24 can be affected by deploying blades 22 from the cutter 16, to contact the inner surface 28 of the casing 24 and by rotation of the drill string 12 from surface, the blades 22 cut through the casing 24 to provide a cut section of casing 26 (FIG. 1*e*).

If a packer 20 is included in the BHA 10, it can be set before casing cutting takes place. Packer 20 will have an internal bearing system to allow an anchor mechanism 34 and seal 36 of the packer 20 to be set and remain stationary while the casing cutter 16 can be rotated by rotation of the string 12 at surface. By creating a seal 36 across the annulus 32, fluid can be pumped down the throughbore 14 which will exit through the casing 24 at the cut point 50 and travel back to surface up the annulus 48. This circulation of fluid can be used to lubricate the blades 52, clear cuttings from the cut point 50 and move cuttings and any debris in the annulus 48 up to surface. This can assist in clearing the annulus 48 to aid later removal of the cut section of casing 26.

Following cutting, the blades 22 are retracted and the packer 20, if used, is unset. The drill string 12 is lifted until the spear 18 is close to the top 54 of the casing 24. The spear 18 is then latched to the casing (FIG. 1*f*). The drill string 12 is raised and the cut section of casing 26 is recovered to surface (FIG. 1*g*).

The entire process has been completed on a single trip into the wellbore 30 saving significant operational time.

Figures 2A, 2B, 2C, 2D, 2E, 2F, 2G:
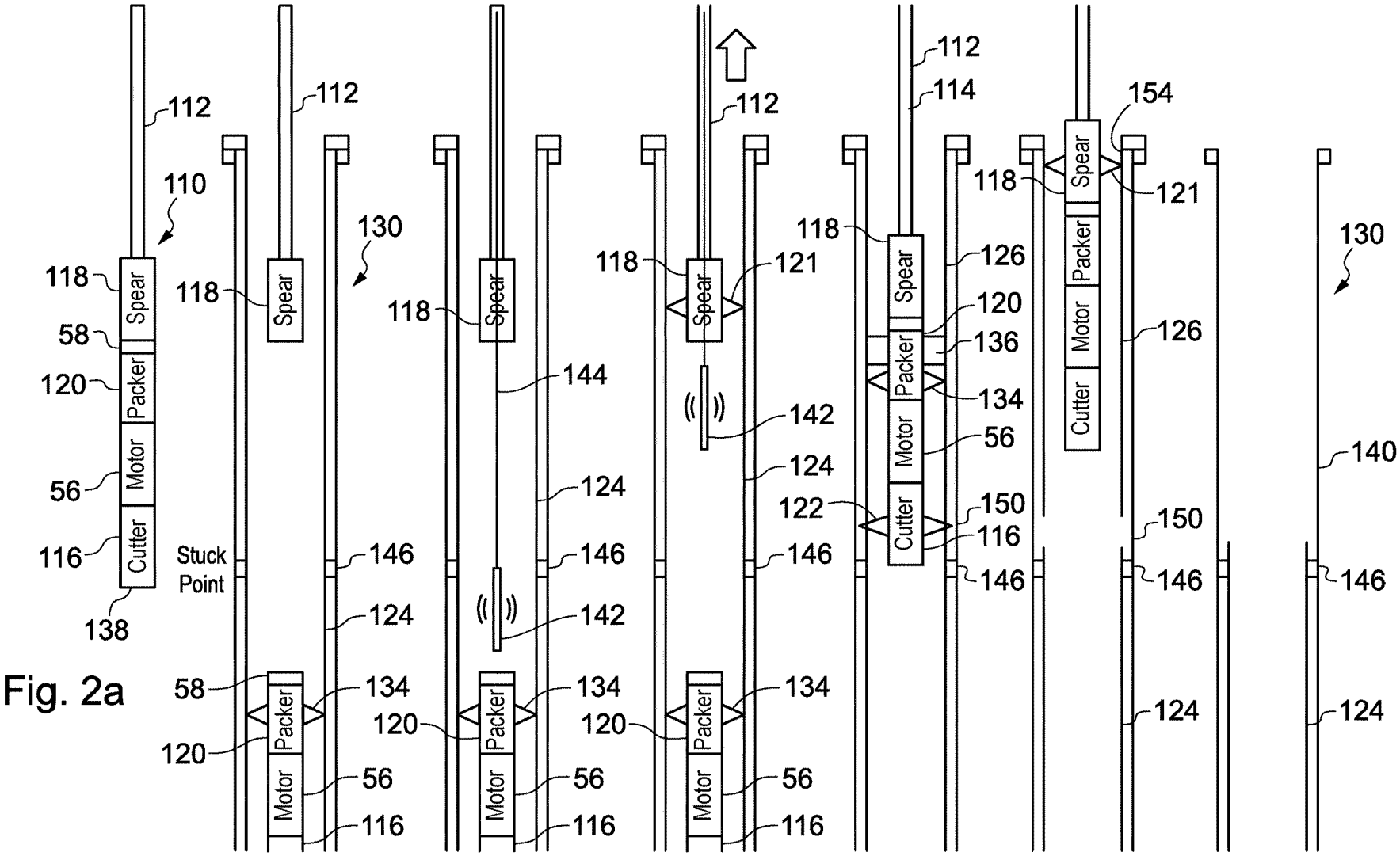

Referring now to FIGS. 2*a* to 2*g* there is illustrated a method of recovering casing 124 from a wellbore 130 according to a second embodiment of the present invention. Like parts to those in FIGS. 1*a* to 1*g* have been given the same reference numeral with the addition of 100 to aid clarity. In the second embodiment, the BHA 110 includes a cutter 116, a downhole motor 56, a disconnect 58 a packer 120 and a spear 118. The cutter 116 and motor 56 are positioned below the packer 120 and the spear 118 is positioned above the packer 120 with the disconnect 58 therebetween. The cutter 116 is still at the end 138 of the BHA 10. (FIG. 2*a*).

The downhole motor 56 is as known in the art to provide rotation to tools located below it in a drill string 112 and is typically operated hydraulically by fluid flowing through the string 112. Disconnects 58 are also known in the industry for detaching tools in a BHA or drill string in a wellbore. Though a packer 120 is illustrated, this may be replaced by just an anchor mechanism 134, if circulation during cutting is not required.

In this embodiment, the BHA 110 is run into the wellbore 130 until the packer 120 is below the estimated stuck point. The packer 120 is then anchored into the casing 124 by its anchoring mechanism 134. The drill string 112 and spear 118 above the packer 120 is detached from the packer 120 by actuating the disconnect 58 and lifted to a point above the estimated stuck point (FIG. 2*b*).

The wireline string 144 with the magnetostrictive tool 142, or other suitable logging tool, is then deployed through the drill pipe 112 from surface until it exits into the casing below the spear 118 (FIG. 2*c*). A first log of the casing interval is made between a depth above the estimated stuck point to a depth below the estimated stuck point. With the spear 118 set into the casing 124 using gripping mechanism 121, the casing 124 is then put into tension by pulling upwards on drill string 112 (FIG. 2*d*). A second log of the casing interval is then made between a depth above the estimated stuck point to a depth below the estimated stuck point. The two casing logs are compared, and the position of the verified stuck point 146 is determined.

The spear 118 is released and the drill string 112 is then lowered and re-connected to the packer 120 via the disconnect 58. The packer 120 is released from the casing 124 and the drill string 112 lifted until the cutter 116 is above the verified stuck point 146 (FIG. 2*e*). The casing 124 is then cut at a point 150 where it is known that the casing is free. Cutting is achieved by operation of the motor 56. Fluid pumped down the throughbore 114 of the drill string 112 actuates the motor 56 to turn the cutter 116 below. If desired the packer 120 can be set to seal 136 the annulus 32 and provide circulation, noting that in this embodiment the packer 120 does not require a bearing to provide rotation below the packer 120 as this is achieved by the motor 56. The cutter 116 may operate in the same way as that described hereinbefore with extending blades 122.

Once a cut section of casing 126 is formed, fluid flow is stopped, the blades 122 retract, the packer 120, if used, is unset and the drill string 112 is lifted until the spear 118 is close to the top 154 of the casing 124. The spear 118 is latched 121 to the cut section of casing 126 (FIG. 2*f*) and the cut section of casing 126 is recovered to surface (FIG. 2*g*).

The entire process has been completed on a single trip into the wellbore 130 saving significant operational time.

Reference is now made to FIGS. 3*a* to 3*g* which illustrate a method of recovering casing 224 from a wellbore 230 according to a third embodiment of the present invention. Like parts to those in FIGS. 1*a* to 1*g* have been given the same reference numeral with the addition of 200 to aid clarity. The third embodiment is provided where it is desired to pull a piece of stuck casing 224. The casing 224 has already been cut at a depth where it is required to pull the casing 224, this is referred to as the deep cut 60 (see FIG. 3*b*). However, it has been established that the cut casing piece 224 is too long to pull in a single piece and so a further cut (or cuts) is required. As has already been said, the decision on where to cut the casing 224 has previously been largely a matter of guesswork. In this type of operation, the casing 224 becomes gradually more stuck with depth into the wellbore 230, and the casing 224 is stuck over a section of the annulus 248 rather than at a specific location. The estimated stuck point is then considered to be a position within this area 62 above the deep cut 60.

Figures 3A, 3B, 3C, 3D, 3E, 3F, 3G:
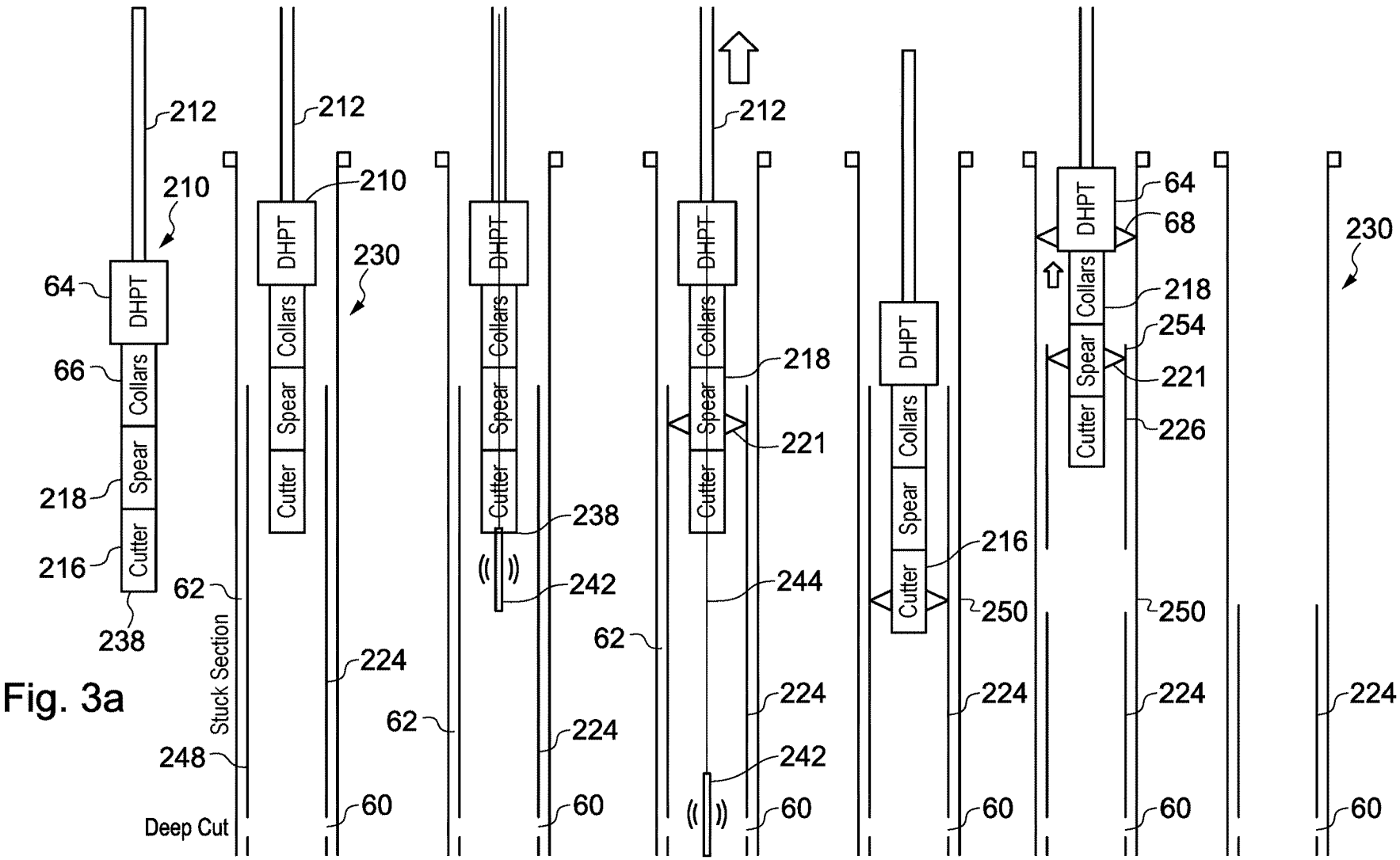

This embodiment consists of a BHA 210 including; a Down Hole Power Tool 64, collars 66, a spear 218 and a cutter 216 (see FIG. 3*a*). The Down Hole Power Tool 64 is configured to grip into the larger casing 240 outside the casing 224 to be recovered. The collars 66, spear 218 and cutter 216 are positioned lower down the string 212, with the cutter 216 at the end 238.

The BHA 210 is run into the wellbore 230 and the spear 218 is positioned just inside the casing 224 to be pulled (FIG. 3*b*). The wireline string 244 with the magnetostrictive tool 242, or other suitable logging tool, is then deployed through the drill pipe 212 from surface until it exits into the casing 224 (FIG. 3*c*). A first log of the casing section is made between a depth above the top of the casing to a depth above the deep cut 60 i.e. over the estimated stuck point. With the spear 218 set into the casing 224, the casing 224 is then put into tension by pulling upwards on drill string 212 (FIG. 3*d*). A second log of the casing interval is then made over the same section and the wireline string 244 is removed from the wellbore 230. The two casing logs are compared. By evaluating the difference between the logs, an estimation of the optimum position to make a cut in the casing 224 is made. This will generally be at a point 250 where the force required to release the newly cut casing piece 226 is close to the maximum allowed or available, with an appropriate safety factor added. This may be considered as above the verified stuck point.

By releasing the spear 218 by unlatching the gripping mechanism 221, the drill string 212 is then lowered so that the cutter 216 is at the correct location 250 and the casing 224 is cut as described hereinbefore (FIG. 3*e*). The drill string 212 is raised until the spear 218 is near the top 254 of the cut casing piece 226 and the spear 218 is set 221. The Down Hole Power Tool 64 is then set to grip 68 the outer casing 240 and operated to apply a pulling force to the cut section of casing 226 via the spear 118 to release the cut casing piece 226 (FIG. 3*f*). The Down Hole Power Tool 64 may be operated several times to jack the cut casing piece 226 from the stuck section 262. Once released, the BHA 210 is removed from the wellbore 230 along with the cut section of casing 226 (FIG. 3*g*).

Following the deep cut 60, the entire process can be completed on a single trip into the wellbore 230 saving significant operational time.

It is noted that the Down Hole Power Tool 64 requires to have a clear throughbore for the passage of the wireline string 244 and the logging tool 244. A Down Hole Power Tool 64 is typically actuated to jack by increasing pressure in the throughbore which is achieved by selectively blocking the throughbore at a location at the lower end of the tool. For the present invention, this can be achieved by providing a drop ball seat in the throughbore at the lower end of the Down Hole Power Tool 64 with a clearance to pass the logging tool therethrough. Drop balls can then be pumped through the seat to operate the Down Hole Power Tool 64 repeatedly.

It will be appreciated that if a comparison of the logs does not provide a verified stuck point 46,146,246 the method can include the steps of repeating the first and second logs over other pairs of first and second lengths. If required a new estimated stuck point can be determined and the drill string 12,112,212 and BHA 10,110,210 can be repositioned for the method to be repeated in the same trip in the wellbore 30,130,230.

The principal advantage of the present invention is that it provides a method of recovering casing from a wellbore in which the stuck point is established, the casing is cut at a location above the stuck point and the casing is recovered in a single trip into the wellbore.

A further advantage of the present invention is that it provides a method of establishing the required force to recover a length of stuck casing.

The invention claimed is:

1. A method of recovering casing from a wellbore, comprising the steps:

(a) mounting a bottomhole assembly (BHA) on a pipe string, the BHA comprising a casing cutter and a casing spear;

(b) running the BHA into the casing;

(c) locating the casing spear at an upper point in the casing, the upper point being above an estimated stuck point;

(d) mounting a logging tool on a wireline string and running the wireline string through a central bore of the pipe string to exit the pipe string below the casing spear;

(e) logging a first length of the casing with the logging tool by movement of the wireline string, the first length including the estimated stuck position;

(f) applying tension to the casing by pulling the pipe string upwards, with the casing spear anchored to the casing;

(g) logging a second length of the casing with the logging tool by movement of the wireline string, the second length including the estimated stuck position and overlapping at least a portion of the first length;

(h) identifying a verified stuck point by comparison of logs of step (e) and step (g);

(i) moving the casing cutter to a cutting position relative to the identified stuck point;

(j) cutting the casing to provide a cut section of casing; and (k) pulling the pipe string with the casing spear anchored to the cut section of casing to recover the cut section of casing from the wellbore.

2. A method of recovering casing from a wellbore according to claim 1 wherein the steps are carried out on a single trip into the wellbore.

3. A method of recovering casing from a wellbore according to claim 1 wherein the logging tool is a wireline deployable magnetostrictive tool.

4. A method of recovering casing from a wellbore according to claim 1 wherein step (g) is carried out whilst the casing is held in tension at step (f).

5. A method of recovering casing from a wellbore according to claim 1 wherein step (g) is carried out after tension has been released following step (f).

6. A method of recovering casing from a wellbore according to claim 1 wherein the method includes the step of recovering the wireline string from the well bore.

7. A method of recovering casing from a wellbore according to claim 6 wherein the step of recovering the wireline string from the well bore is completed before step (j).

8. A method of recovering casing from a wellbore according to claim 7 wherein the step of recovering the wireline string from the well bore is completed before step (i).

9. A method of recovering casing from a wellbore according to claim 1 wherein the bottomhole assembly further comprises a packer, the packer being located above the cutter in the bottomhole assembly.

10. A method of recovering casing from a wellbore according to claim 9 wherein the method includes the step of setting the packer and pumping fluid through the pipe string to the cutting position to circulate fluid preferentially up an outside of the cut section of casing.

11. A method of recovering casing from a wellbore according to claim 1 wherein the method includes the step of operating the cutter to radial extend blades to cut the casing.

12. A method of recovering casing from a wellbore according to claim 11 wherein the blades are rotated by virtue of rotation of the casing cutter to perform the cut.

13. A method of recovering casing from a wellbore according to claim 1 wherein the method includes the step of rotating the pipe string from surface to rotate the casing cutter.

14. A method of recovering casing from a wellbore according to claim 1 wherein the bottomhole assembly includes a motor, the motor operating to rotate the casing cutter.

15. A method of recovering casing from a wellbore according to claim 14 wherein the bottomhole assembly includes in order: the casing spear, a disconnect, an anchor mechanism, the motor and the casing cutter.

16. A method of recovering casing from a wellbore according to claim 15 wherein the method also includes, between steps (b) and (c), the additional steps of:

(i) locating the anchor mechanism at a lower point in the casing, the lower point being below the estimated stuck point in the casing;

(ii) operating the anchor mechanism to anchor the bottomhole assembly to the casing at the lower point; and (iii) operating the disconnect to release the casing spear and the pipe string from the bottomhole assembly;

and between steps (g) and (i), the additional steps of:

(iv) running the casing spear down to the anchor mechanism and reconnecting the bottomhole assembly to the pipe string; and (v) disengaging the anchor mechanism from the casing.

17. A method of recovering casing from a wellbore according to claim 15 wherein the anchor mechanism is part of a packer.

18. A method of recovering casing from a wellbore according to claim 1 wherein steps (e) to (g) are repeated over other pairs of first and second length if a verified stuck point is not identified at step (h).

19. A method of recovering casing from a wellbore according to claim 18 wherein a new estimated stuck point is determined and the casing spear moved to reposition it as per step (c).

* * * * *